US008011566B2

(12) United States Patent
Robertson et al.

(10) Patent No.: US 8,011,566 B2
(45) Date of Patent: Sep. 6, 2011

(54) HINGED LID FOR A FOOD CONTAINER WITH PLASTIC LOWER RING

(75) Inventors: Ronald D. Robertson, Kansas City, MO (US); Michael Liming, New Vienna, OH (US)

(73) Assignee: Huhtamaki, Inc., De Soto, KS (US)

( * ) Notice: Subject to any disclaimer, the term of this patent is extended or adjusted under 35 U.S.C. 154(b) by 451 days.

(21) Appl. No.: 12/046,538

(22) Filed: Mar. 12, 2008

(65) Prior Publication Data

US 2009/0230177 A1 Sep. 17, 2009

(51) Int. Cl.
*B65D 43/16* (2006.01)

(52) U.S. Cl. ..... 229/125.13; 220/833; 220/837; 229/5.5

(58) Field of Classification Search ..... 229/5.5, 229/125.08, 125.11, 125.13; 220/797, 798, 220/802, 833, 834, 835, 836, 837
See application file for complete search history.

(56) References Cited

U.S. PATENT DOCUMENTS

| | | | | |
|---|---|---|---|---|
| 2,541,604 A | | 2/1951 | Normandin | |
| 3,414,183 A | * | 12/1968 | Wilcox | 229/125.13 |
| 3,417,897 A | | 12/1968 | Johnson | |
| 4,375,711 A | | 3/1983 | Franzen | |
| 4,671,423 A | * | 6/1987 | Murphy | 220/797 |
| 4,883,193 A | * | 11/1989 | Christensson | 220/837 |
| 5,027,969 A | * | 7/1991 | Lesquir | 220/270 |
| 5,050,763 A | * | 9/1991 | Christensson | 220/810 |
| 5,145,088 A | | 9/1992 | Goujon | |
| 5,303,839 A | * | 4/1994 | Blumenschein | 220/783 |
| 5,307,948 A | * | 5/1994 | Blackburn et al. | 220/269 |
| 5,573,134 A | * | 11/1996 | Chenault et al. | 220/276 |
| 5,887,744 A | * | 3/1999 | Mejias | 220/835 |
| 6,003,203 A | | 12/1999 | Fowlston | |
| 6,772,904 B1 | | 8/2004 | Gilliam | |
| 7,097,446 B2 | | 8/2006 | Crider | |
| 2001/0035424 A1 | * | 11/2001 | Combe et al. | 220/835 |
| 2004/0079757 A1 | * | 4/2004 | Ciccone | 220/836 |
| 2004/0118848 A1 | * | 6/2004 | Marshall | 220/835 |
| 2009/0032545 A1 | * | 2/2009 | Zeiler et al. | 220/833 |

* cited by examiner

*Primary Examiner* — Gary E Elkins
(74) *Attorney, Agent, or Firm* — Husch Blackwell LLP

(57) ABSTRACT

A hinged lid structure is provided that is configured for attachment to a paperboard receptacle. The lid structure includes a tamper evident shield structure that requires breaking at least a portion of the shield structure away to effect exposure of a portion of the lid structure to a user to effect opening of the lid structure. The lid structure also includes a plurality of peripherally spaced apart webs for providing structural rigidity to the lid structure and therefore additional strength the upper open end of the receptacle it is attached to.

20 Claims, 3 Drawing Sheets

HINGED LID FOR A FOOD CONTAINER WITH PLASTIC LOWER RING

BACKGROUND OF INVENTION

Lids for food containers are well known in the art. Such lids may be attached to container receptacles in a variety of manners including a friction connection, a screw connection, a permanent connection, an adhesive connection and the like. Sometimes, the lid may be hingedly mounted to the receptacle to retain the lid connected to the receptacle when open.

In the manufacture of some food containers, the receptacle may be made from paperboard and have a seamed sidewall, a bottom connected to the sidewall, and an upper portion forming the open end of the receptacle having an upper rolled lip. The rolled lip provides some resistance to bending of the upper portion of the receptacle during use. However, one problem with such containers is inadequate strength particularly around its upper open end. Sometimes, the upper open end will collapse during use therefore causing spillage.

Another challenge with such containers is the ability to retain the container sealed against potential contamination. Often, a solution to this problem is to have a membrane sealed to an upper portion of the container overlying the access opening in addition to the lid. Such a structure, while providing a seal and tamper evidence, adds cost to the container and inconvenience in opening the container.

It would be desirable to have a lid structure configured for attachment to a paperboard receptacle where the lid structure provides a hinged connection between the moveable cover portion of the lid structure and the receptacle, provides adequate strength to the upper open end of the receptacle, and provides adequate tamper evidence. It would also be desirable to have a lid structure that is economical to manufacture and convenient to use.

SUMMARY OF INVENTION

The present invention provides a hinged lid structure that is configured for attachment to a paperboard receptacle. The lid structure includes a collar having inner and outer wall members that form a channel configured for receiving an upper rolled lip of a paperboard receptacle. The lid structure also includes a ring hingedly mounted to the collar. The ring has a skirt with an edge portion. The lid structure further includes a shield member that circumscribes at least a substantial portion of the collar and a removable tab. The shield member and removable tab provide tamper evidence and prevent access to the edge portion of the skirt until the removable tab is detached. After the tab is detached, the edge portion of the skirt is exposed to facilitate moving the ring from its closed position to an open position. The lid structure can also include a plurality of peripherally spaced apart webs extending between the outer wall member of the collar and the shield member. The webs provide structural rigidity to the collar and therefore strengthen the upper open end of the receptacle it is attached to. The lid structure can be molded as a single integral unit.

BRIEF DESCRIPTION OF DRAWINGS

Like numbers throughout the various figures designate like or similar parts and/or construction.

DETAILED DESCRIPTION

Figure 1:
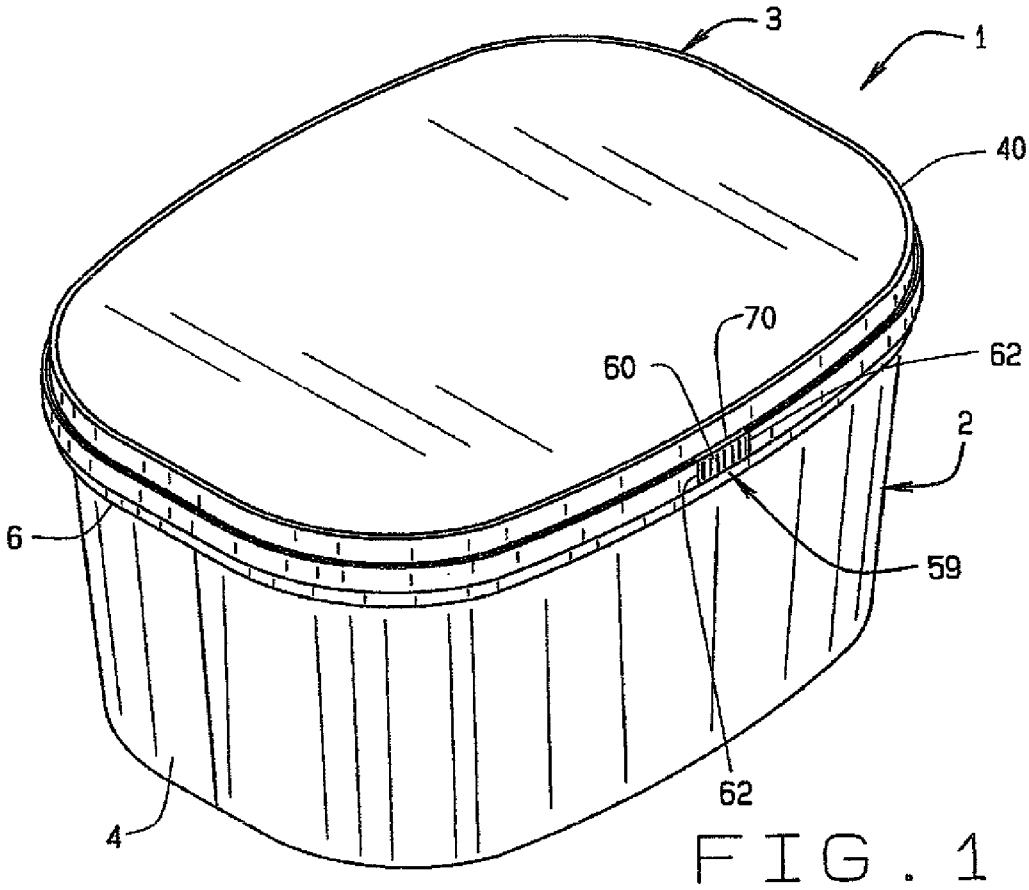
FIG. 1 is a perspective view of a hinged lid structure attached to a receptacle showing the lid structure in a closed configuration in accordance with one embodiment of the present invention.
Figure 2:
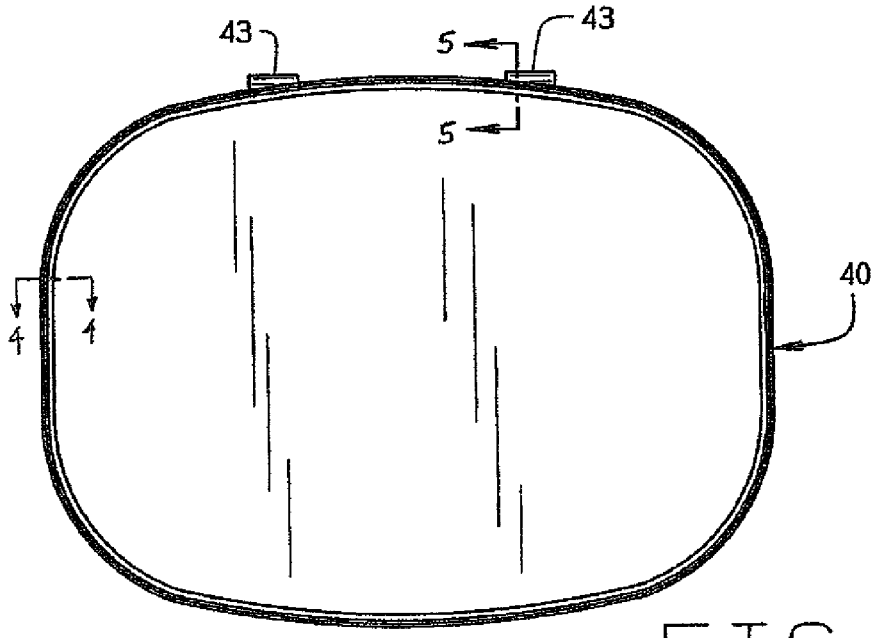
FIG. 2 is a top plan view of the hinged lid structure of FIG. 1 showing the lid structure in a closed configuration.

The reference numeral 1 designates generally a container having a receptacle 2 and a lid structure 3. The receptacle 2 includes a sidewall 4 and bottom wall 5 and may be made of any suitable material such as a coated paperboard. The sidewall 4 has an upper open end portion 6 defining an access opening 7. The sidewall 4 may be tapered to provide for nesting and may be formed with a side seam 12 as is known in the art. The sidewall 4 may be formed by wrapping a blank about a mandrel and bonding side edge portions together to form the seam 12.

The sidewall 4 includes a rolled lip 15 formed at the upper end thereof. The rolled lip 15 may be formed by rolling an upper portion of the sidewall 4 as is known in the art. The rolled lip 15 has a top surface 17 that may be joined to the lid structure 3 as by adhesion or heat sealing the rolled lip 15. The rolled lip 15 also includes a bottom shoulder 18.

In the illustrated structure, the lid structure 3 includes a collar 25 configured to be secured to the sidewall 4. The collar 25 circumscribes at least a substantial portion of the upper perimeter of the sidewall 4 and has a channel 27 formed by an inner wall member 28, an outer wall member 29, and a bight portion 30. The collar 25 adds resistance to bending of the upper portion of the sidewall 4 and helps effect securement of the lid structure 3 to the receptacle 2. As shown, the collar 25 circumscribes the entirety of the perimeter of the sidewall 4 at the rolled lip 15. The collar 25 may be of a polymeric material and injection molded. The inner wall 28 provides an opening through the collar 25 which is substantially equal in size to the opening 6 formed by the sidewall 4 providing an unimpeded access opening to obtain access to the contents in the receptacle 2.

Figures 3, 5:
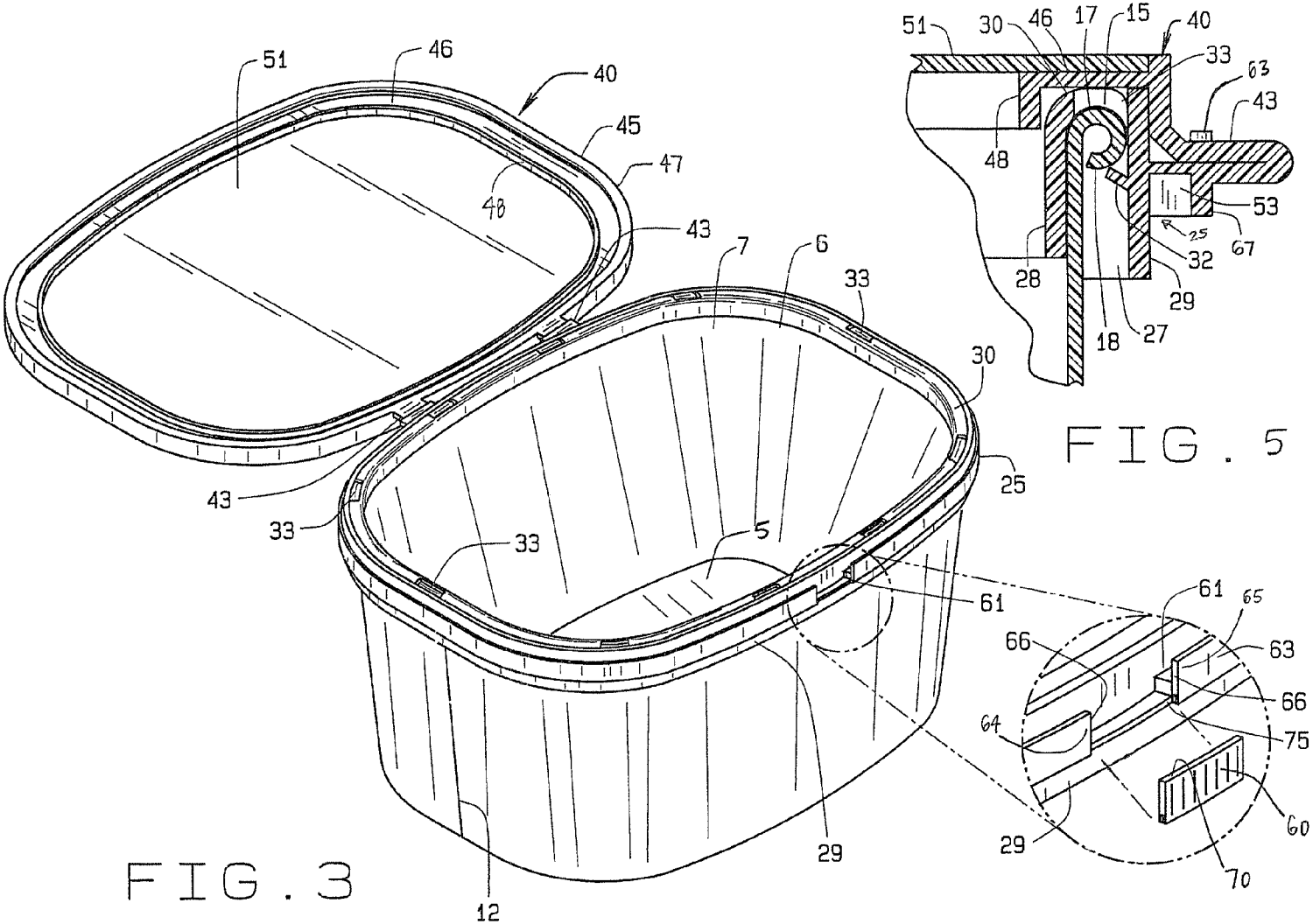
FIG. 3 is a perspective view of a hinged lid structure showing the lid structure in an open configuration and having a portion enlarged to show structural details in accordance with one embodiment of the present invention.
FIG. 5 is an enlarged partial cross-sectional view taken along the line 5-5 showing the lid structure attached to the rolled upper lip of the receptacle.
Figure 4:
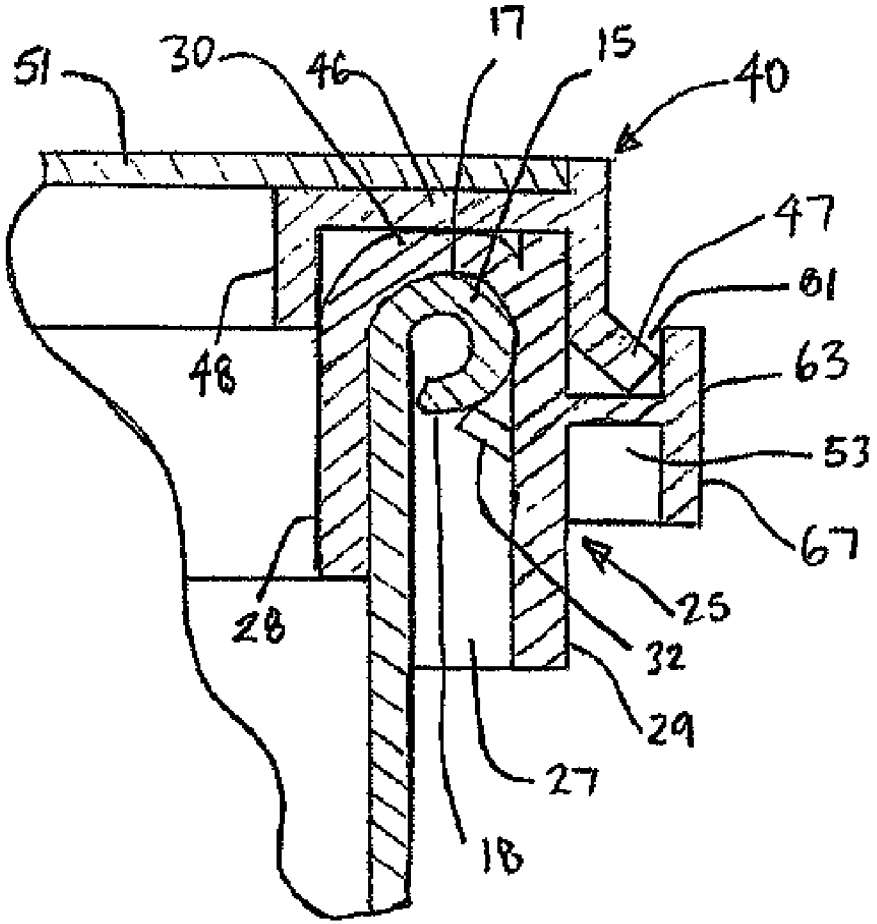
FIG. 4 is an enlarged partial cross-sectional view taken along the line 4-4 showing the lid structure attached to the rolled upper lip of the receptacle.

As best seen in FIGS. 4-5, there is at least one and preferably a plurality of tongues 32 projecting into the channel 27 from the inner surface of the outer wall 29. A tongue 32 is positioned under a respective opening 33 through the bight 30 to provide for forming of the tongues 32 as by molding. The tongues 32 are integral with the outer wall 29 in a preferred embodiment. As best seen in FIG. 3, there are a plurality of openings 33 spaced around the collar 25 with each opening 33 overlying a respective tongue 32. The tongues 32 are upwardly and inwardly inclined as seen in FIGS. 4-5 to provide for mechanical attachment of the lid structure 3 to the receptacle 4. The tongues 32 will engage the shoulder 18 of the rolled lip 15 to retain the lid structure 3 mounted to the receptacle 4.

The lid structure 3 includes a ring designated generally 40. The ring 40 is hingedly mounted to the collar 25 as by one or more hinge members 43 of which two are shown. The hinge members 43 may be integrally formed between the collar 25 and ring 40 or may be mechanically attached to one and integral with the other. In a preferred embodiment, the hinge members 43 are integral and have a thinned area (not shown)

to provide a "living hinge." The thickness of such a thinned area may be in the order of 0.005 inches to 0.020 inches. The ring 40, as best seen in FIG. 3, has a depending outer skirt 45 with a flange 46 extending inwardly therefrom to be in overlying relation to the bight 30. An inner skirt 48 may also be provided to depend from the flange 46 to be positioned just inside the inner wall 28 and to engage the inner wall 28 when the ring 40 is in a closed position.

The ring 40 may also be configured to receive a top wall 51. The top wall 51 can be secured to the flange 46 as with adhesion. The wall 51 may be paperboard with polymer coating in which event, the member 51 may be secured to the flange 46 via heat fusion. The container may be provided with indicia on the wall 51 and/or sidewall 4 for labeling compliance, decoration, marketing information and the like.

The lid 25 also includes a tamper evident shield structure 59 to prevent the opening of the lid 25 without providing evidence of the initial opening. The tamper evident shield structure 59 includes a shield member 63 and a removable tab 60. The shield member 63 circumscribes at least a substantial portion of the outer wall 29 and has a first end 64 and a second end 65. As illustrated in FIGS. 3-4, the shield member 63 and outer wall member 29 form a channel 61. Channel 61 is sized, shaped, and positioned to receive an edge portion 47 of the ring skirt 45 therein to selectively prevent access to the edge portion 47.

As mentioned, the tamper evident shield structure 59 includes a removable tab 60. The removable tab 60 is positioned between the shield member 63 first and second ends 64, 65 to complete the peripheral channel 61 covering the entire edge portion 47 of the ring skirt 45. The removable tab 60 is integrally formed with either the shield member 63 or the ring 40. In the illustrated embodiment, the tab 60 is integral with the shield member 63 and is joined thereto at the faces 66 forming fracture zones 62. The fractures zones 62 must be broken or severed and the tab removed in order to gain access to the edge portion 47 of the skirt 45 for opening the ring 40. The type of polymer used to form the tab 60 is such as to provide for fracture at the zones 62 for complete removal of the tab 60. The separation zones 62 may be formed by thinned areas of molded polymeric material between the tab 60 and the shield member 63. The separation zones 62, 75 may be thinned areas to direct the fractures and can have a thickness of about one-half or less of the thickness of adjacent components.

The tab has a top edge 70 exposed for access by a user of the container 1. By bending the tab 60 outwardly and downwardly, the tab is fractured from its attachment to the shield member 63 at opposite end faces 66 thereof and also preferably fractured at separation zone 75 from its attachment to the shield member 63 exposing the edge portion 47 of the skirt 45. Once the tab 60 is removed, the user has access to the edge portion 47 and can move the ring 40 to an open position.

As shown in FIGS. 4-5, the shield member 63 may have a portion 67 extending below the channel 61. A plurality of peripherally spaced apart webs 53 maybe provided that extend between the outer wall 29 and the lower portion 67 of the shield member 63. The webs 53 provide structural rigidity to the collar 25 and therefore strengthen the upper open end of the receptacle 2.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

We claim:

1. A hinged lid structure configured to be attached to a paperboard receptacle having a free end with an outwardly rolled lip, a sidewall depending therefrom, and a bottom, said lid structure comprising:

a collar including inner and outer wall members forming a first channel therebetween and a shield member having first and second ends, said shield member circumscribing substantially the entire outer wall member forming a second channel between said outer wall member and said shield member;

a ring including a flange and an outer skirt, said flange configured to overlie said first channel and said outer skirt configured to have an edge portion positioned in said second channel when said ring is in a closed position;

a removable tab extending between said shield member first and second ends configured to conceal said ring outer skirt edge portion until separated from said shield member; and a hinge connecting said ring to said collar.

2. The hinged lid structure of claim 1 wherein said collar, ring, removable tab, and hinge are molded as a single integral unit.

3. The hinged lid structure of claim 1 wherein said collar, ring, removable tab, and hinge have portions thereof molded of a polymeric material.

4. The hinged lid structure of claim 1 wherein said collar includes at least one upwardly angled tongue projecting from said outer wall member into said first channel configured for engaging said receptacle rolled lip.

5. The hinged lid structure of claim 1 wherein said collar includes a plurality of peripherally spaced apart webs extending between said outer wall member and said shield member.

6. The hinged lid structure of claim 1 wherein said ring includes an inner skirt configured to be positioned inside of said collar inner wall member and engage said collar inner wall member when said ring is in a closed position.

7. The hinged lid structure of claim 1 wherein said ring is configured for receiving a paperboard cover therewith.

8. The hinged lid structure of claim 1 wherein said removable tab is initially secured to said shield member at a separation zone.

9. The hinged lid structure of claim 8 wherein said separation zone is a zone of weakened material between said removable tab and said shield member.

10. The hinged lid structure of claim 1 wherein said hinge is a living hinge.

11. A hinged lid structure configured to be attached to a paperboard receptacle having a free end with an outwardly rolled lip, a sidewall depending therefrom, and a bottom, said lid structure comprising:

a collar including inner and outer wall members forming a first channel therebetween and a shield member having first and second ends, said shield member circumscribing substantially the entire outer wall member forming a second channel between said outer wall member and said shield member;

a plurality of peripherally spaced apart webs extending between said outer wall member and said shield member;

a ring hingedly mounted to said collar, said ring including a flange and an outer skirt with an edge portion, wherein said flange is configured to overlie said first channel and said outer skirt edge portion is configured to be positioned in said second channel when said ring is in a closed position;

a removable tab extending between said shield member first and second ends configured to conceal a segment of said outer skirt edge portion; and wherein the periphery of said outer skirt edge portion is concealed until said removable tab is detached from said collar thus exposing a segment of said outer skirt edge portion.

12. The hinged lid structure of claim 11 wherein said collar includes at least one upwardly angled tongue projecting from said outer wall member into said first channel configured for engaging said receptacle rolled lip.

13. The hinged lid structure of claim 11 wherein said ring is configured for receiving a paperboard cover therewith.

14. The hinged lid structure of claim 11 wherein said removable tab is initially secured to said shield member at a separation zone.

15. The hinged lid structure of claim 14 wherein said separation zone is a zone of weakened material between said removable tab and said shield member.

16. A hinged lid structure configured to be attached to a paperboard receptacle having a free end with an outwardly rolled lip, a sidewall depending therefrom, and a bottom, said lid structure comprising:

a collar with a portion configured to be positioned outside of said container free end and circumscribing at least a substantial portion of said container free end and having a flange portion overlying a top end of said container free end;

a ring hingedly mounted to said collar and operable to move relative to said collar, said ring including an outer skirt with an edge portion; and a shield structure circumscribing substantially the entire collar forming a channel between said collar and said shield member, said shield structure having a portion removably secured to said collar to conceal said ring outer skirt edge portion until separated from said collar.

17. The hinged lid structure of claim 16 wherein said collar, ring, and shield structure are molded as a single integral unit.

18. The hinged lid structure of claim 16 wherein said ring is configured for receiving a paperboard cover therewith.

19. The hinged lid structure of claim 16 further comprising a plurality of peripherally spaced apart webs extending between an exterior surface of said collar and an interior surface of said shield member.

20. The hinged lid structure of claim 16 wherein said ring includes an inner skirt configured to be positioned inside of said collar and engage said collar when said ring is in a closed position.

* * * * *